US007086912B2

(12) United States Patent
Matsuura et al.

(10) Patent No.: US 7,086,912 B2
(45) Date of Patent: Aug. 8, 2006

(54) ELECTRICAL TERMINAL HAVING RESISTANCE AGAINST MATING TERMINAL REMOVAL

(75) Inventors: Naoya Matsuura, Kanagawa (JP); Hirokazu Hori, Kawasaki (JP); Kotaro Kobayashi, Atsugi (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/533,424

(22) PCT Filed: Oct. 8, 2003

(86) PCT No.: PCT/US03/31882

§ 371 (c)(1),
(2), (4) Date: Sep. 12, 2005

(87) PCT Pub. No.: WO2004/042875

PCT Pub. Date: May 21, 2004

(65) Prior Publication Data

US 2006/0128233 A1 Jun. 15, 2006

(30) Foreign Application Priority Data

Oct. 30, 2002 (JP) ..... 2002/315965

(51) Int. Cl.
*H01R 13/187* (2006.01)

(52) U.S. Cl. ..... 439/845; 439/850

(58) Field of Classification Search ..... 439/843–850, 439/441, 858, 861, 436–440
See application file for complete search history.

(56) References Cited

U.S. PATENT DOCUMENTS

| | | | | |
|---|---|---|---|---|
| 1,635,256 | A * | 7/1927 | Carter | 439/858 |
| 3,705,376 | A * | 12/1972 | Kinkaid et al. | 439/161 |
| 4,367,006 | A * | 1/1983 | Rehbogen et al. | 439/495 |
| 5,401,185 | A * | 3/1995 | Wang et al. | 439/441 |
| 5,593,328 | A * | 1/1997 | Okada et al. | 439/851 |
| 6,056,604 | A * | 5/2000 | Roy et al. | 439/845 |
| 6,293,832 | B1 * | 9/2001 | Yamamoto | 439/850 |
| 6,352,453 | B1 * | 3/2002 | Saitoh | 439/843 |
| 6,364,722 | B1 * | 4/2002 | Yamamoto | 439/850 |
| 6,428,365 | B1 * | 8/2002 | Yamamoto | 439/849 |
| 6,527,600 | B1 * | 3/2003 | Alonso Merino et al. | 439/849 |
| 6,544,079 | B1 * | 4/2003 | Renkes et al. | 439/848 |
| 6,544,080 | B1 * | 4/2003 | Yamamoto | 439/849 |
| 6,570,306 | B1 * | 5/2003 | Henrici et al. | 313/318.01 |
| 2001/0002350 | A1 * | 5/2001 | Kashiyama et al. | 439/848 |
| 2002/0022412 | A1 * | 2/2002 | Alonson Merino et al. | 439/849 |
| 2002/0065005 | A1 * | 5/2002 | Renkes et al. | 439/849 |

* cited by examiner

*Primary Examiner*—Ross Gushi
(74) *Attorney, Agent, or Firm*—Charles S. Cohen

(57) ABSTRACT

An electrical terminal is provided for mating with a blade-like mating terminal. The electrical terminal includes a base having a front mating end and a rear terminating end. A spring arm is folded rearwardly over the base from the front mating end thereof to a rear bowed end of the spring arm. A contact arm is folded back forwardly from the rear bowed end beneath the spring arm above the base and spaced therefrom for receiving the blade-like mating terminal inserted between the contact arm and the base. A sharp edge is formed on the contact arm facing the rear terminating end of the base and engageable with the blade-like mating terminal to resist unmating of the terminals.

7 Claims, 9 Drawing Sheets

PRIOR ART

ELECTRICAL TERMINAL HAVING RESISTANCE AGAINST MATING TERMINAL REMOVAL

FIELD OF THE INVENTION

This invention generally relates to the art of electrical connectors and, particularly, to an electrical terminal having increased resistance to the removal of a mating terminal, such as in electrical fuse sockets and fuse terminals.

BACKGROUND OF THE INVENTION

Generally, an electrical connector typically includes some form of insulating or dielectric housing which mounts one or more conductive terminals for engaging the terminals of a complementary mating connector. One connector may include receptacle or female terminals for receiving the plug or male terminals of a complementary mating connector. Typical male terminals include flat or blade-like contact portions.

For instance, FIG. 16 herein shows a fuse-type electrical connector assembly as seen in Japanese Utility Model Registration Nos. 2570607, 2573677 and 2600992. As seen in FIG. 16, one or more electrical fuses, generally designated 18, include blade-like terminals or fuse tails 20. An electrical terminal, generally designated 22, is stamped and formed of conductive sheet spring metal and includes a box-like engagement section 22*a* having a pair of contacts 22*b* integral with the front end thereof and a terminating section 22*c* at the rear end thereof. The terminating section includes a pair of crimp arms 22*d* for crimping onto the outer insulation or cladding of an electrical wire, along with a pair of crimp arms 22*e* for crimping onto an exposed conductive core of the wire. Each fuse tail 20 is inserted between the confronting contacts 22*b* of one of the terminals 22 to be pinched by the opposing contacts with a predetermined pressure.

FIG. 17 shows another electrical terminal, generally designated 24, for mating with a blade-like terminal 26 as disclosed in Japanese Utility Model Registration Nos. 2543561 and 2602692. As shown, electrical terminal 24 includes a rectangular base 24*a* having longitudinal raised ridges 24*b*. A pair of spring arms 24*c* are curled over opposite sides of the base and include contact portions 24*d*. When the blade-like terminal 26 is inserted into electrical terminal 24, the blade-like terminal is pinched between ridges 24*b* of base 24*a* and contacts 24*d* under a predetermined pressure.

In order to increase the resistance to removal of blade-like terminals 20 and 26 from electrical terminals 22 and 24, respectively, the electrical terminals can be constructed to increase the predetermined pressure by which the blade-like terminals are pinched. However, by increasing the removal pressure, the insertion pressure of the blade-like terminals correspondingly is increased and this is undesirable because the mating of the connectors is made difficult The present invention is directed to solving these problems by providing an electrical terminal with an increased resistance against removal of the mating terminal without increasing the insertion force between the terminals.

SUMMARY OF THE INVENTION

An object, therefore, of the invention is to provide a new and improved electrical terminal having increased resistance to removal of a mating terminal without increasing the mating forces between the terminals. As disclosed herein, the electrical terminal is constructed for mating with a blade-like mating terminal.

In the exemplary embodiment of the invention, the terminal includes a base having a front mating end and a rear terminating end. A spring arm is folded rearwardly over the base from the front mating end thereof to a rear bowed end of the spring arm. A contact arm is folded back forwardly from the rear bowed end beneath the spring arm, above the base and spaced therefrom for receiving the blade-like mating terminal inserted between the contact arm and the base. A sharp edge is provided on the contact arm facing the rear terminating end of the base and engageable with the blade-like mating terminal to resist unmating of the terminals.

As disclosed herein, the electrical terminal is stamped and formed of conductive sheet metal material. The base may have a terminating tail projecting from the rear terminating end thereof. The base may also have engaging teeth on opposite edges thereof for engagement in an appropriate mounting passage in a connector housing.

According to one aspect of the invention, the base is generally flat and rectangular in shape. The base has a raised embossment on the top thereof for engaging the blade-like mating terminal.

According to another aspect of the invention, the spring arm has a front bowed end joined to the base. The front bowed end includes an opening through which the blade-like mating terminal is inserted between the contact arm and the base. The spring arm is bifurcated by means of a front-to-rear slot communicating with the opening. The slot extends through the rear bowed end of the spring arm. The slot extends into the contact arm and stops at the sharp edge which engages the blade-like mating terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGS. and in which:

DETAILED DESCRIPTION OF THE PREFERRED EMBODIMENT

Figure 1:
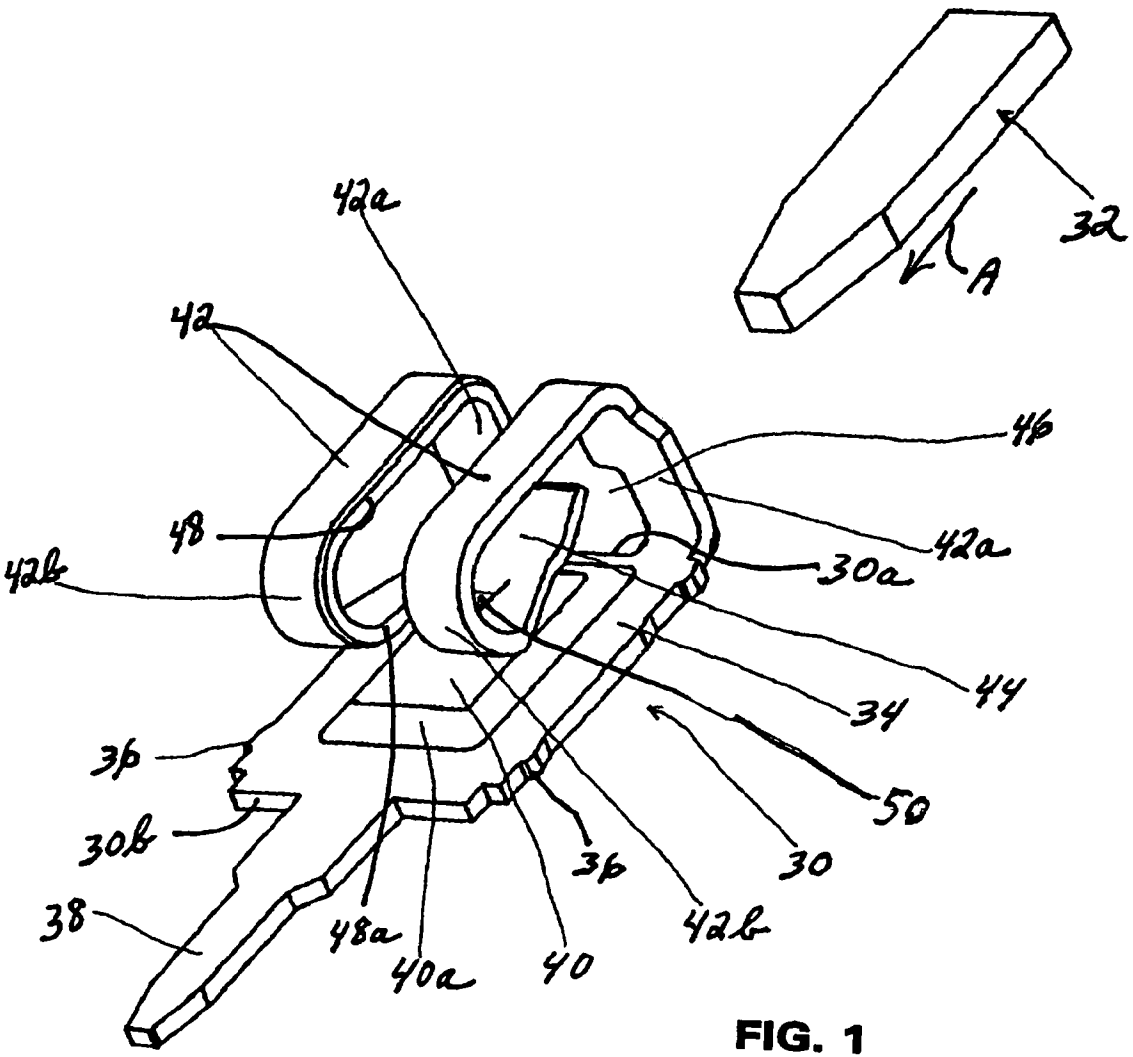
FIG. 1 is a perspective view of an electrical terminal incorporating the concepts of the invention, along with the tip of a blade-like mating terminal.
Figure 2:
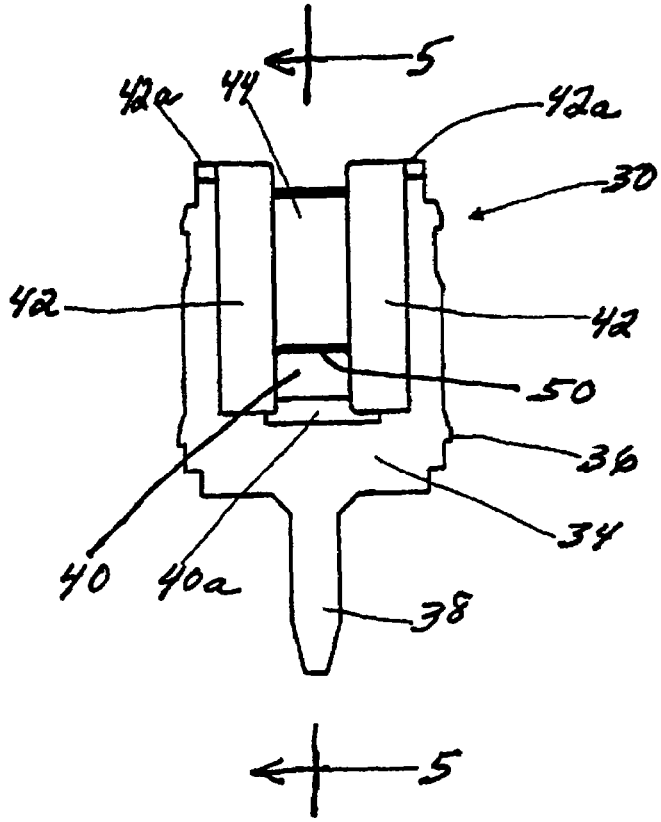
FIG. 2 is a top plan view of the terminal as viewed in FIG. 1.
Figure 3:
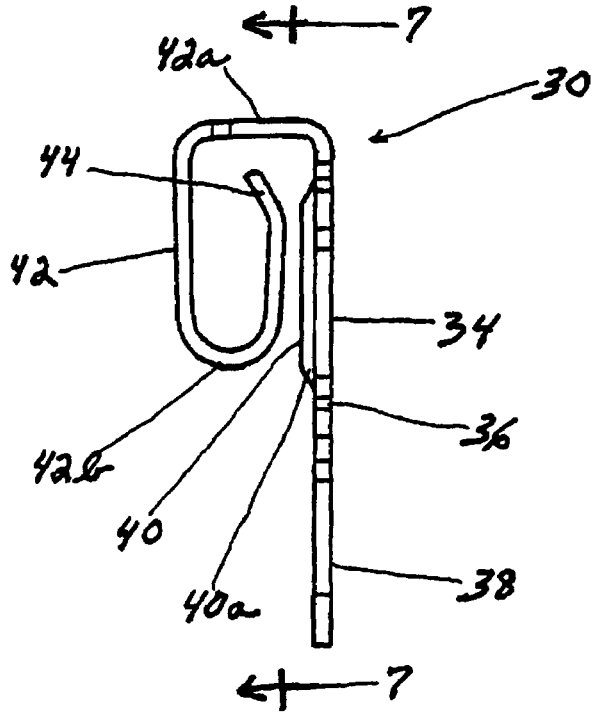
FIG. 3 is a side elevational view of the terminal, looking at the right-hand side of FIG. 1.
Figure 4:
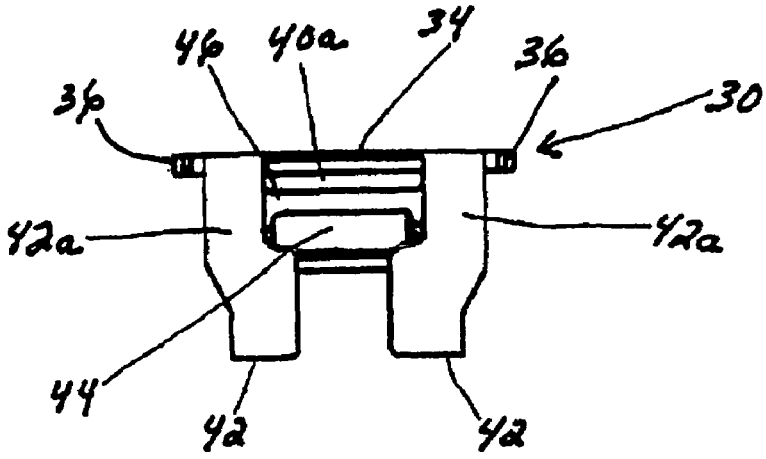
FIG. 4 is a front elevational view of the terminal.
Figure 5:
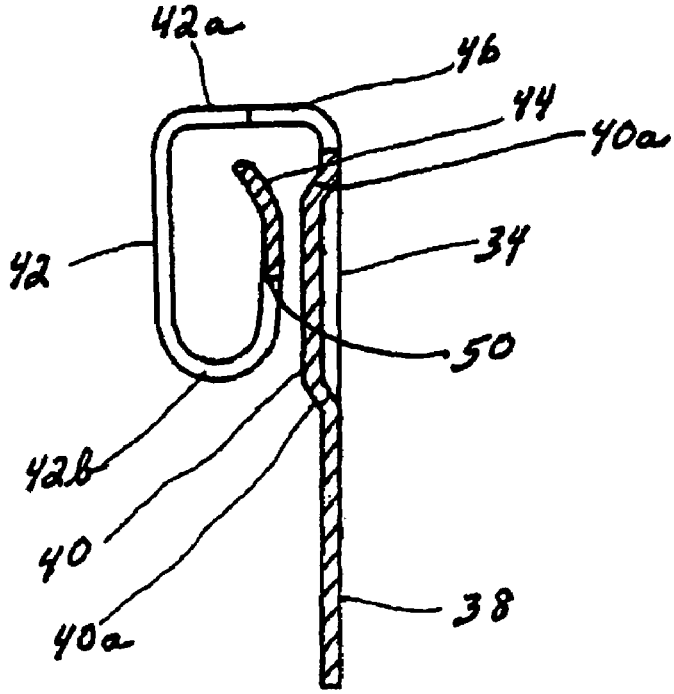
FIG. 5 is a section taken generally along line 5—5 in FIG. 2.

Referring to the drawings in greater detail, and first to FIGS. 1–7, the invention is incorporated in an electrical terminal, generally designated 30, for receiving a blade-like mating terminal, generally designated 32, in the direction of arrow ▯ A▯ (FIG. 1). Electrical terminal 30 includes a flat, generally rectangular base 34 which has engaging teeth 36 stamped at opposite edges thereof for engagement in an appropriate mounting passage of a mating connector housing, such as an electrical fuse socket described hereinafter. The base has a front mating end 30*a* and a rear terminating end 30*b*. A terminating tail 38 projects from the rear terminating end of the base. The base also includes a raised embossment 40 located generally in the center of the top of the base and surrounded by tapered sides 40*a*.

A bifurcated spring arm 42 is folded at a front bowed end 42*a* rearwardly over base 34 from the front mating end 30*a* of the base, to a rear bowed end 42*b* of the spring arm. The bifurcated spring arm is generally parallel to base 34. A contact arm 44 is folded back forwardly from rear bowed end 42*b* beneath spring arm 42 above base 34 for receiving the blade-like mating terminal 32 inserted between contact arm 44 and base 34.

As best seen in FIG. 1, spring arm 42 and contact arm 44 are bifurcated by stamping an opening 46 in the front bowed end 42*a* which joins the spring arm to base 34. A front-to-rear slot 48 splits or bifurcates spring arm 42 and is in communication with opening 46. The slot extends through rear bowed end 42*b* of the spring arm, as is seen clearly in FIG. 1, and extends into contact arm 44, as at 48*a*. The slot stops at a sharp edge 50 on contact arm 44 facing rear terminating end 30*b* of base 34 and engageable with the blade-like mating terminal 32 to resist unmating of terminals 30 and 32.

Figure 6:
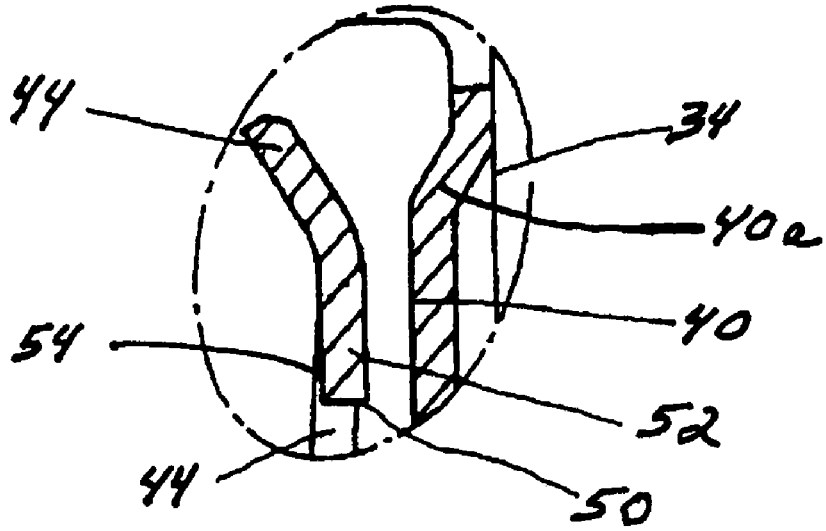
FIG. 6 is an enlarged view of the contact area of the terminal as viewed in FIG. 5.
Figure 7:
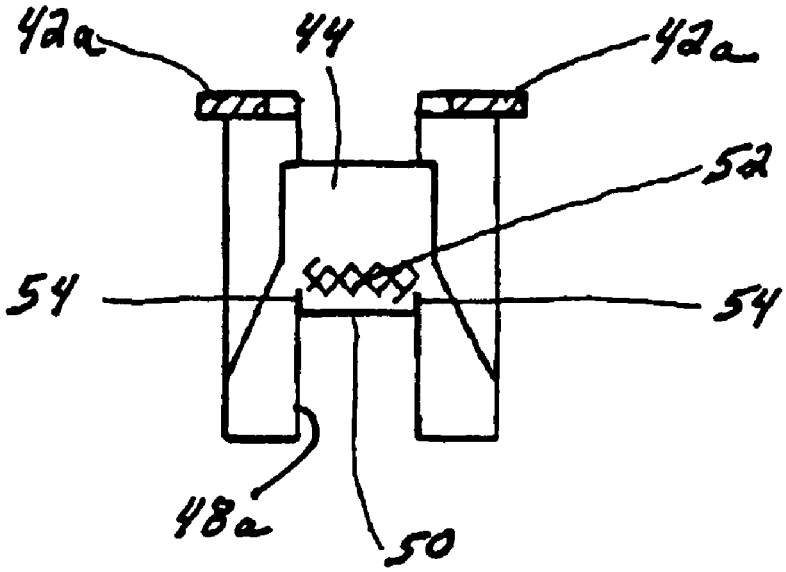
FIG. 7 is a section taken generally along line 7—7 in FIG. 3.

More particularly, a tongue 52 is stamped and formed out of contact arm 44 as best seen in FIG. 6, to form sharp edge 50. It can be seen that tongue 52 is bent slightly downwardly toward base 34 and out of the plane of the contact arm so that sharp edge 50 is exposed and faces in the insertion direction of mating terminal 32 to, thereby, resist withdrawal of the mating terminal out of terminal 30. Tongue 52 is formed by a pair of cuts 54 in contact arm 44 as seen in FIG. 7, so that the tongue can be bent downwardly as seen in FIG. 6.

Figure 8:
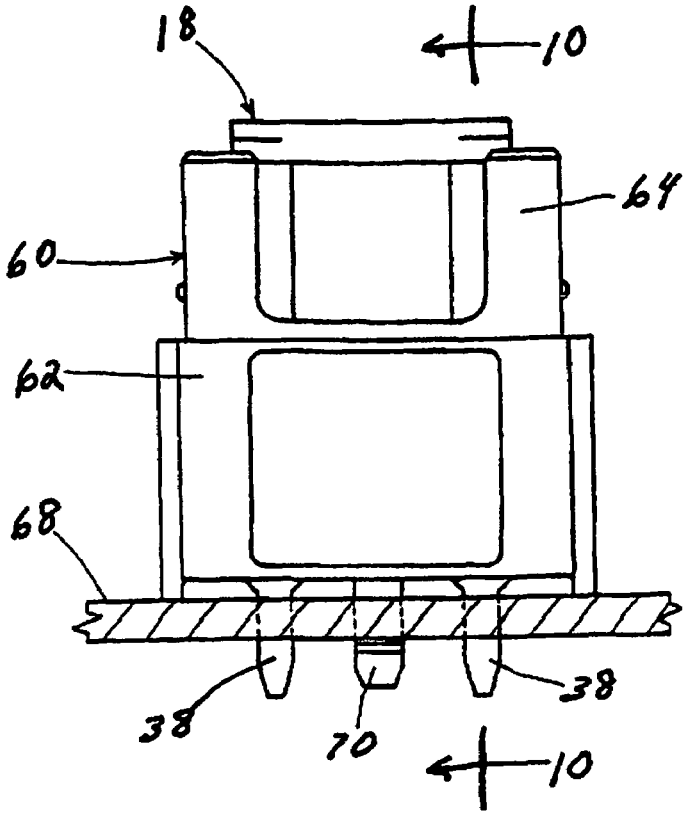
FIG. 8 is a front elevational view of an electrical fuse socket.
Figure 9:
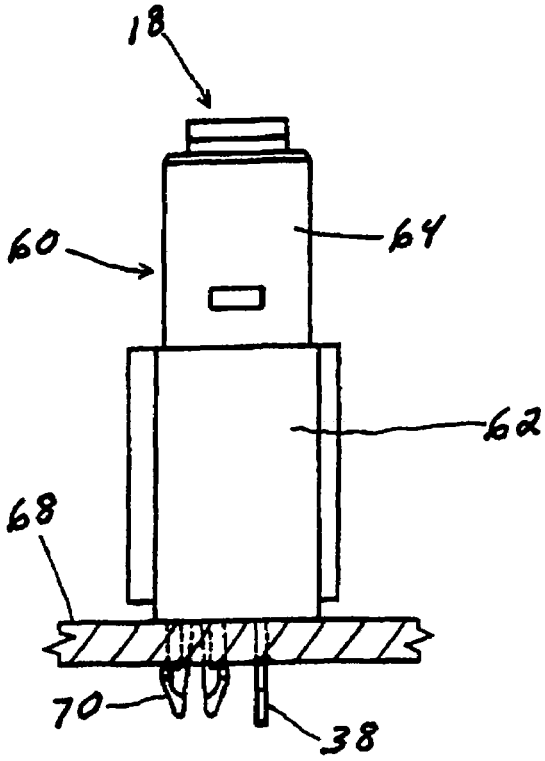
FIG. 9 is a side elevational view of the fuse socket of FIG. 8.
Figure 10:
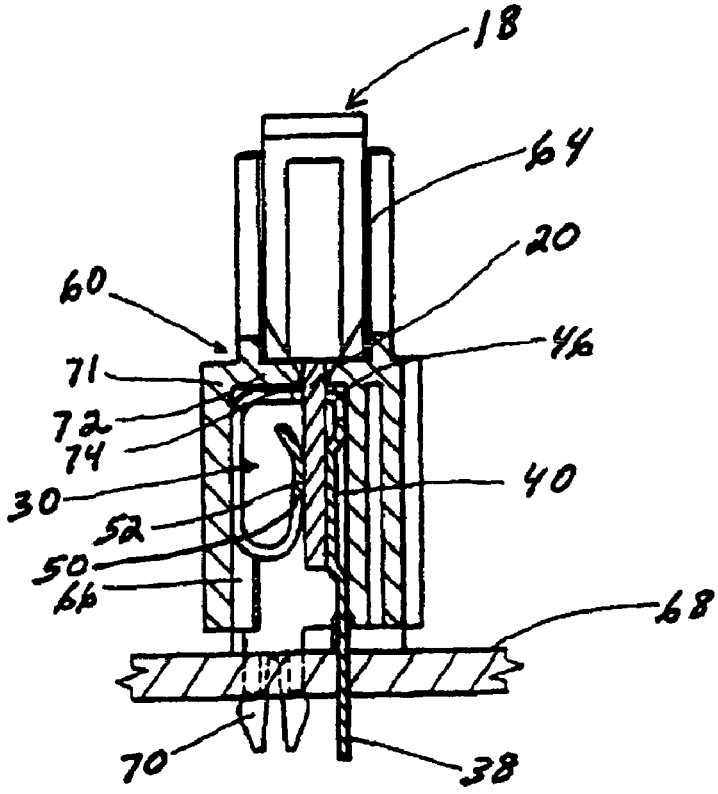
FIG. 10 is a section taken generally along line 10—10 in FIG. 8.
Figure 16:
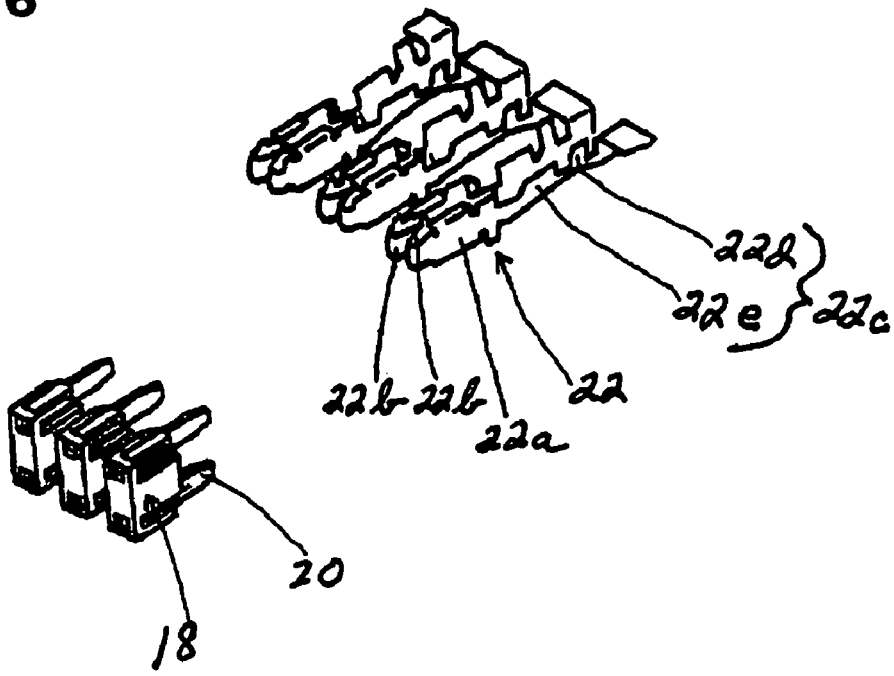
FIGS. 16 and 17 are perspective views of the prior art described in the "Background", above.
Figure 17:
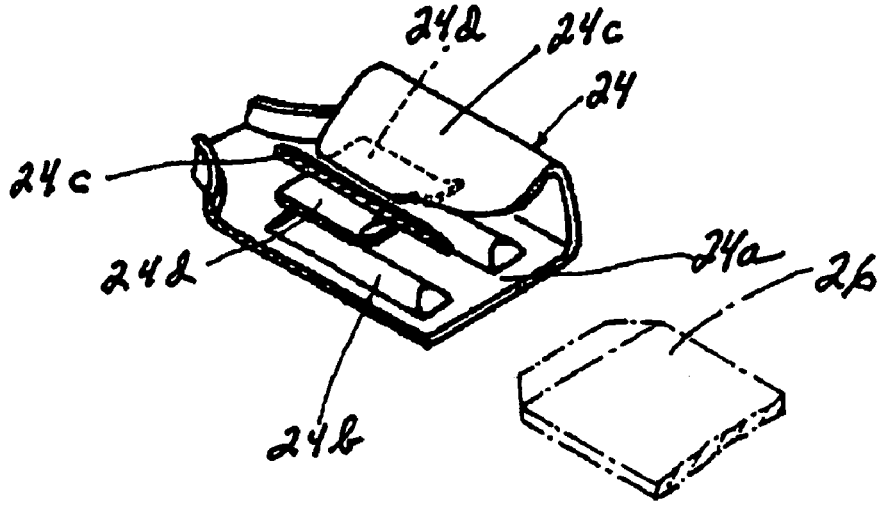
PRIOR ART FIG. 17

A pair of electrical terminals 30 are shown herein mounted in an electrical fuse socket, generally designated 60 in FIGS. 8–10. An electrical fuse 18, having a pair of blade-like mating terminals 20 similar to that shown in FIG. 16, also is inserted into fuse socket 60. The fuse socket includes a dielectric housing 62 having an upper fuse cavity 64 which receives fuse 18. A pair of lower terminal cavities 66 receive a pair of electrical terminals 30 on opposite sides of a vertical center line of socket housing 62. These terminal cavities are open at the bottom of the socket housing at which fuse socket 60 is mounted on a printed circuit board 68. The socket housing includes a plurality of fastening pegs 70 which mount the fuse socket to the circuit board. A partition 72 separates upper fuse cavity 64 from lower terminal cavities 66. A pair of apertures 74 are formed in partition 72 for receiving therethrough the pair of blade-like mating terminals 20 of electrical fuse 18.

Figure 11:
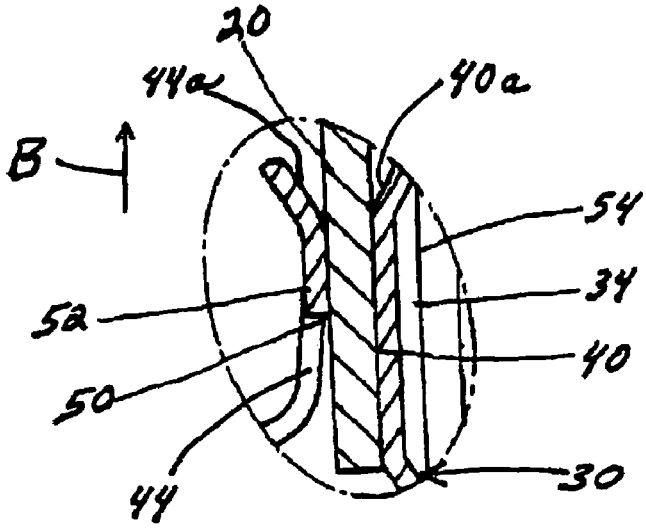
FIG. 11 is an enlarged sectional view of the contact area as viewed in FIG. 10.

FIGS. 10 and 11, and particularly the enlarged depiction of FIG. 11, show how the blade-like mating terminals 20 of the electrical fuse mate with electrical terminals 30. Specifically, each mating terminal 20 engages one of the pair of electrical terminals 30 mounted in fuse socket 60 (FIG. 10). It can be seen clearly in FIG. 11 that the blade-like mating terminal 20 is inserted between raised embossment 40 of base 54 and tongue 52 of contact arm 44. If an attempt is made to withdraw mating terminal 20 from electrical terminal 30 in the direction of arrow ▯ B▯ (FIG. 11), sharp edge 50 of tongue 52 on contact arm 44 resists unmating of the terminals. This resistance is significantly greater than the insertion forces of mating terminal 20 into terminal 30. FIG. 11 shows how the tapered side 40*a* of raised embossment 40 is engageable by mating terminal 20, and contact arm 44 also is flared, as at 44*a*, to guide the mating terminal smoothly into its mated position.

Figure 12:
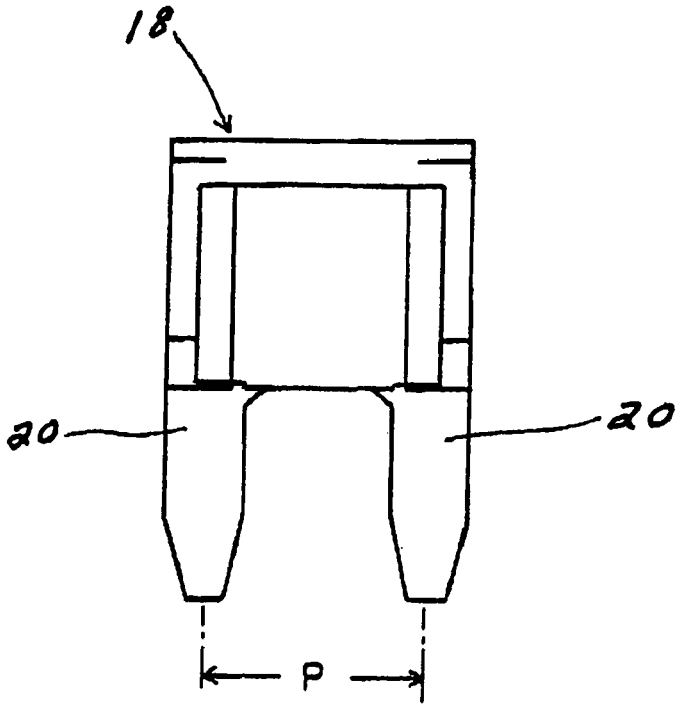
FIG. 12 is an elevational view of an electrical fuse.

FIG. 12 shows electrical fuse 18 with its pair of spaced blade-like mating terminals 20. The mating terminals are spaced a distance represented by arrows ▯ P▯ which corresponds to the ▯ pitch▯ or spacing of electrical terminals 30 within fuse socket 60.

Figure 13:
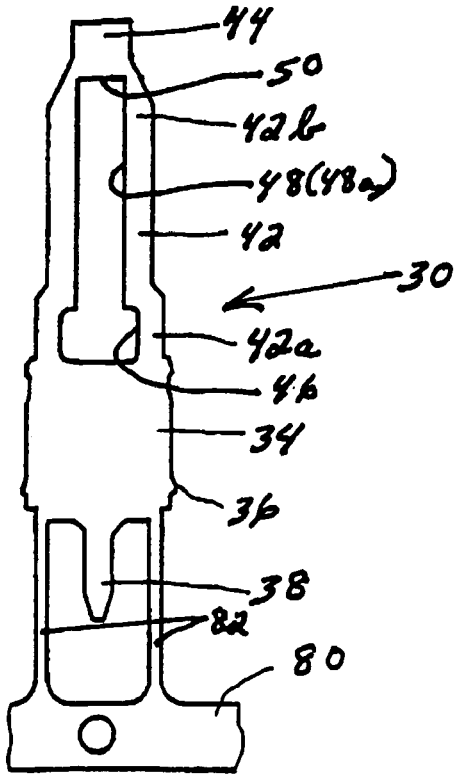
FIG. 13 is a plan view of the stamping pattern on a sheet of metal material for forming the electrical terminal of FIG. 1.
Figure 14:
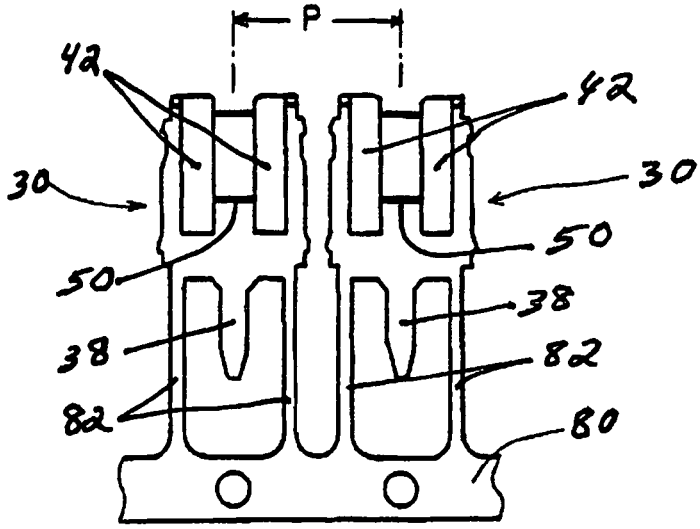
FIG. 14 is a plan view showing a pair of the electrical terminals formed from the sheet of metal, material and still joined by a carrier strip thereof.

FIGS. 13 and 14 show how electrical terminal 30 is stamped and formed out of a sheet of conductive metal material to form a ▯ blank▯ of sheet metal material. The reference numerals in FIG. 13 correspond to the components of the terminal after it is stamped and formed as shown in FIG. 1. The terminal is shown in FIG. 13 still joined to a carrier strip 80 of the sheet metal material by a pair of webs 82.

FIG. 14 shows a pair of the electrical terminals 30 formed from their ▯ blank▯ configuration of FIG. 13, into the configuration of FIG. 1, but still joined to carrier strip 80 by webs 82. It can be seen that the spacing between the center-lines of terminals 30 in FIG. 14 is represented by arrows ▯ P▯ , and this spacing should correspond to the distance ▯ P▯ between terminal blades 20 of electrical fuse 18 in FIG. 12.

Figure 15:
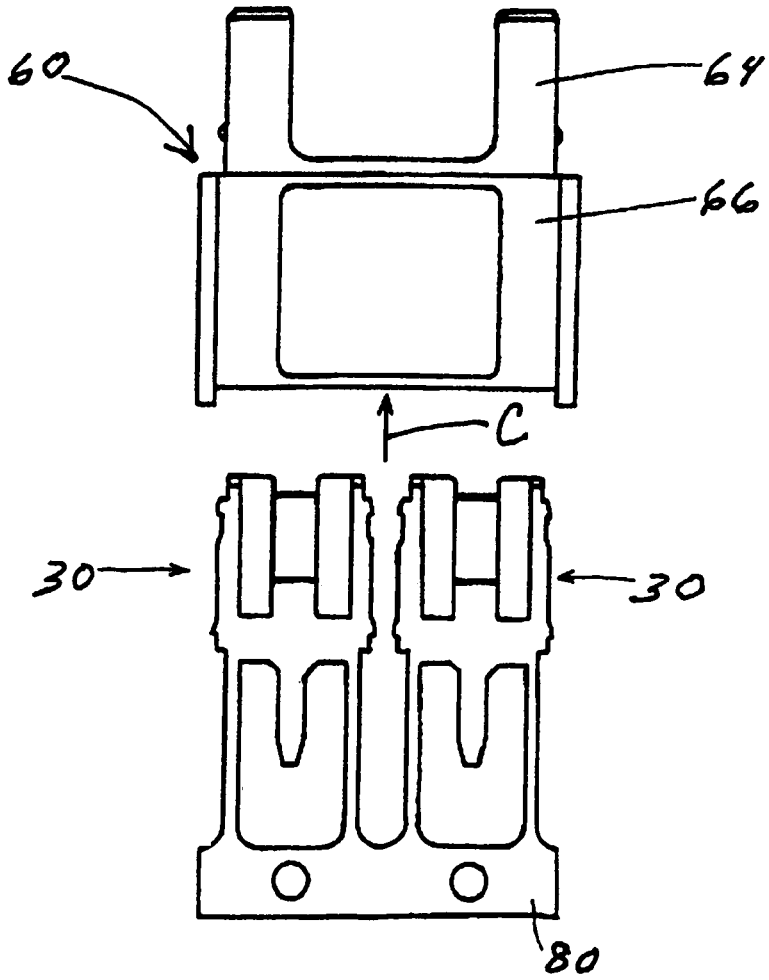
FIG. 15 is a view showing the formed electrical terminals of FIG. 14 in the process of being inserted into the fuse socket.

Finally, FIG. 15 shows that the pair of stamped and formed electrical terminals 30 can be inserted into fuse socket 60. Specifically, the terminals are inserted into lower terminal cavities 66 of the fuse socket.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical terminal (30) stamped and formed of conductive sheet metal material for mating with a blade-like mating terminal (32), comprising:

a generally flat base (34) having a front mating end (30*a*) and a rear terminating end (30*b*);

a spring arm (42) having a front bowed end (42*a*) joined to the front mating end of base and folded rearwardly over the base to a rear bowed end (42*b*) of the spring arm, and including an opening (46) in the front bowed end through which the blade-like mating terminal (32) is inserted, the spring arm being bifurcated by means of a front-to-rear slot (48) communicating with said opening (46);

a contact arm (44) folded back forwardly from said rear bowed end (42*b*) beneath the spring arm (42) above the base (34) and spaced therefrom for receiving the blade-like mating terminal (32) inserted between the contact arm and the base; and a sharp edge (50) on said contact arm (44) facing the rear terminating end of the base and engageable with the blade-like mating terminal (32) to resist unmating of the terminals (30,32).

2. The electrical terminal of claim 1 wherein said base (34) is generally rectangular.

3. The electrical terminal of claim 1 wherein said base (34) has a raised embossment (40) on the top thereof for engaging the blade-like mating terminal (32).

4. The electrical terminal of claim 1 wherein said base (34) has a terminating tail (38) projecting from the rear terminating end (30*b*) thereof.

5. The electrical terminal of claim 1 wherein said base (34) has engaging teeth (36) on opposite edges thereof for engagement in an appropriate mounting passage in a connector housing.

6. The electrical terminal of claim 1 wherein said slot (48*a*) extends through the rear bowed end (42*b*) of the spring arm (42).

7. The electrical terminal of claim 6 wherein said slot (48*a*) extends into said contact arm (44) and stops at said sharp edge (50).

* * * * *